US007767376B2

(12) United States Patent
Mang et al.

(10) Patent No.: US 7,767,376 B2
(45) Date of Patent: Aug. 3, 2010

(54) TONER COMPOSITIONS

(75) Inventors: Mark E. Mang, Rochester, NY (US); Thomas C. Dombroski, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 313 days.

(21) Appl. No.: 11/903,182

(22) Filed: Sep. 20, 2007

(65) Prior Publication Data

US 2009/0081577 A1 Mar. 26, 2009

(51) Int. Cl.
*G03G 9/087* (2006.01)

(52) U.S. Cl. ..... 430/137.18

(58) Field of Classification Search ..... 430/137.18
See application file for complete search history.

(56) References Cited

U.S. PATENT DOCUMENTS

| | | | | |
|---|---|---|---|---|
| 3,590,000 | A | 6/1971 | Palermiti et al. | |
| 4,797,339 | A | 1/1989 | Maruyama et al. | |
| 4,952,477 | A | 8/1990 | Fuller et al. | |
| 4,983,488 | A | 1/1991 | Tan et al. | |
| 4,990,424 | A | 2/1991 | Van Dusen et al. | |
| 4,996,127 | A | 2/1991 | Hasegawa et al. | |
| 5,057,392 | A * | 10/1991 | McCabe et al. | 430/109.2 |
| 5,166,026 | A | 11/1992 | Fuller et al. | |
| 5,227,460 | A | 7/1993 | Mahabadi et al. | |
| 5,364,729 | A | 11/1994 | Kmiecik-Lawrynowicz et al. | |
| 5,403,693 | A | 4/1995 | Patel et al. | |
| 5,866,290 | A | 2/1999 | Sacripante et al. | |
| 5,888,691 | A | 3/1999 | Laing et al. | |
| 6,017,671 | A | 1/2000 | Sacripante et al. | |
| 6,359,105 | B1 | 3/2002 | Ianni et al. | |
| 6,835,518 | B2 | 12/2004 | Tachi et al. | |
| 7,001,702 | B2 | 2/2006 | Cheng et al. | |
| 7,208,252 | B2 | 4/2007 | Grande et al. | |
| 7,232,636 | B2 | 6/2007 | Semura et al. | |
| 2006/0216626 | A1 * | 9/2006 | Sacripante et al. | 430/109.4 |

FOREIGN PATENT DOCUMENTS

| | | |
|---|---|---|
| EP | 1 705 524 | 9/2006 |
| JP | 2006065015 A | 3/2006 |

OTHER PUBLICATIONS

European Search Report for EP 08 16 0984 dated Jan. 20, 2009.

* cited by examiner

*Primary Examiner*—John L Goodrow
(74) *Attorney, Agent, or Firm*—Carter, DeLuca, Farrell & Schmidt, LLP

(57) ABSTRACT

The present disclosure provides processes for producing toners which include an annealing step and toners produced by these processes. The process includes a continuous annealing step, which increases the glass transition temperature of the resulting toner.

18 Claims, No Drawings

TONER COMPOSITIONS

BACKGROUND

The present disclosure relates to processes useful in providing toners suitable for electrostatographic apparatuses, including xerographic apparatuses such as digital, image-on-image, and similar apparatuses.

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system. Toners should also display acceptable triboelectric properties, which may vary with the type of carrier or developer composition.

Toners useful for xerographic applications should possess certain properties relating to storage stability and particle size integrity. That is, the particles should remain intact and not agglomerate until they are fused on paper. Due to energy conservation measures, and more stringent energy characteristics placed on xerographic engines, such as on xerographic fusers, it may be desirable to reduce the fixing temperatures of toners onto paper, thereby reducing power consumption and extending the lifetime of the fuser system.

For a contact fuser, that is, a fuser which is in contact with the paper and the image, the toner should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Toners that may be used at desirable fusing temperatures, possessing properties including excellent document offset and heat cohesion, remain desirable.

SUMMARY

The present disclosure provides processes for producing toners which include a continuous annealing step, which increases the glass transition temperature of the resulting toner. In embodiments, processes of the present disclosure may include melt-mixing an amorphous resin, a crystalline resin, an optional wax, and a colorant to form a toner, pelletizing the toner, continuously annealing the pelletized toner by heating the toner to a temperature of from about 50° C. to about 90° C. for a period of time from about 2 minutes to about 60 minutes, said temperature being above the glass transition temperature of the toner, processing the annealed toner to form toner particles, and recovering the resulting toner particles.

In other embodiments, a process of the present disclosure may include contacting an amorphous polymer such as polyester resins, branched polyester resins, polyimide resins, branched polyimide resins, and combinations thereof, with a crystalline polymer to form a binder resin; contacting the binder resin with a colorant comprising a pigment, dye, optional wax, or combinations thereof; melt-mixing the binder resin, colorant, and optional wax to form a toner; pelletizing the toner to form toner pellets; continuously annealing the toner pellets in an apparatus comprising a rotary kiln, by heating the toner to a temperature of from about 50° C. to about 90° C. for a period of time form about 2 minutes to about 60 minutes, said temperature being above the glass transition temperature of the toner; processing the annealed toner to form toner particles; and recovering the resulting toner particles.

Toners produced by these processes, systems for producing these toners, and methods for their use are also provided.

DETAILED DESCRIPTION OF EMBODIMENTS

The present disclosure provides for continuous processes suitable for forming toners. While any toner may be produced in accordance with the methods herein, in embodiments a toner may include a binder including an amorphous polymeric resin and a crystalline resin, in combination with a suitable colorant. In embodiments, release agents such as waxes may also be added.

Examples of amorphous polymeric resins suitable for use herein include polyester resins, branched polyester resins, polyimide resins, branched polyimide resins, poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, combinations thereof, and the like.

In embodiments, the amorphous polyester may be a homopolymer or copolymer of two or more monomers. Suitable polyesters include, in embodiments, those derived from a dicarboxylic acid and a diphenol. Examples of such resins include those disclosed in U.S. Pat. No. 3,590,000, the disclosure of which is hereby incorporated by reference in its entirety. Suitable amorphous polyester materials include those commercially available as GTUF and FPESL-2 from Kao Corporation, Japan, and EM 181635 from Reichhold, Research Triangle Park, North Carolina, and the like.

In embodiments, the amorphous polyester may be obtained from the reaction of bisphenol A and propylene oxide or propylene carbonate, followed by the reaction of the resulting product with fumaric acid (see U.S. Pat. No. 5,227,460, the disclosure of which is hereby incorporated by reference in its entirety). For example, the amorphous polyester can include a polypropoxylated bisphenol A fumarate polyester. This resin may be used in a linear form, or partially crosslinked as described in U.S. Pat. No. 6,359,105, the disclosure of which is hereby incorporated by reference in its entirety. In embodiments, a blend of a linear resin and a partially crosslinked resin may be used to adjust the rheology of the resulting toner.

Branched amorphous resins which may be utilized in embodiments of the present disclosure include branched polyesters, branched polyamides, branched polyimides, branched polystyrene-acrylates, branched polystyrene-methacrylates, branched polystyrene-butadienes, or branched polyester-imides, branched alkali sulfonated polyesters, branched alkali sulfonated polyamides, branched alkali sulfonated polyimides, branched alkali sulfonated polystyrene-acrylates, branched alkali sulfonated polystyrene-methacrylates, branched alkali sulfonated polystyrene-butadienes, or branched alkali sulfonated polyester-imides, branched sulfonated polyester resins, branched copoly(ethylene-terephthalate)-copoly(ethylene-5-sulfo-isophthalate), branched copoly(propylene-terephthalate)-copoly(propylene-5-sulfo-isophthalate), branched copoly(diethylene-terephthalate)-copoly(diethylene-5-sulfo-isophthalate), branched copoly (propylene-diethylene-terephthalate)-copoly(propylene-diethylene-5-sulfo-isophthalate), branched copoly (propylene-butylene-terephthalate)-copoly(propylene-butylene-5-sulfo-isophthalate), branched copoly (propoxylated bisphenol-A-fumarate)-copoly (propoxylated bisphenol A-5-sulfo-isophthalate), branched copoly(ethoxylated bisphenol-A-fumarate)-copoly(ethoxylated bisphenol-A-5-sulfo-isophthalate), or branched copoly(ethoxylated bisphenol-A-maleate)copoly(ethoxylated bisphenol-A-5-sulfo-isophthalate), combinations thereof, and the like.

In embodiments, where utilized, the branched amorphous polyester resin may be prepared by the polycondensation of an organic diol, a diacid or diester, an optional sulfonated difunctional monomer, and a multivalent polyacid or polyol as the branching agent and a polycondensation catalyst.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, combinations thereof, and the like. The organic diacid or diester may be present, for example, in an amount from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, combinations thereof, and the like. The amount of organic diol selected can vary, and be present, for example, in an amount from about 45 to about 52 mole percent of the resin.

Suitable alkali sulfonated difunctional monomers include, where the alkali is lithium, sodium or potassium, dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, combinations thereof, and the like. Effective difunctional monomer amounts of, for example, from about 0.1 to about 2 weight percent of the resin can be utilized.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, for example, those possessing from about 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, combinations thereof, and the like.

The amorphous polyester may have a glass transition temperature of from about 50° C. to about 65° C., in embodiments from about 54° C. to about 62° C.

The amorphous resin may be present in an amount from about 10 to about 90 percent by weight of the binder, in embodiments from about 65 to about 85 percent by weight of the binder.

The crystalline resin may be, for example, a polyester, a polyamide, a polyimide, a polyolefin such as a polyethylene, a polypropylene, a polybutylene or an ethylene-propylene copolymer, a polyisobutyrate, an ethylene-vinyl acetate copolymer, combinations thereof, and the like. In embodiments, the crystalline resin may be sulfonated.

Examples of a suitable crystalline resins include, but are not limited to, poly(ethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-succinate), copoly(5-sulfo-isophthaloyl)-copoly(propylene-succinate), copoly(5-sulfo-isophthaloyl)-copoly(butylene-succinate), copoly(5-sulfo-isophthaloyl)-copoly(pentylene-succinate), copoly(5-sulfo-isophthaloyl)-copoly(hexylene-succinate), copoly(5-sulfo-isophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), poly(octylene-adipate), combinations thereof, and the like.

In embodiments, the crystalline polyester material may be derived from a monomer system including an alcohol such as 1,4-butanediol, 1,6-hexanediol, 1,10-decanediol, and combinations thereof, with a dicarboxylic acid such as fumaric acid, succinic acid, oxalic acid, adipic acid, sebacic acid, and combinations thereof. For example, in embodiments the crystalline polyester may be derived from 1,4-butanediol, adipic acid, and fumaric acid.

The crystalline polyester may have a melting point of from about 65° C. to about 125° C., in embodiments from about 70° C. to about 115° C.

The crystalline resin may be present, for example, in an amount of from about 10 to about 50 percent by weight of the binder, in embodiments from about 15 to about 40 percent by weight of the binder.

The crystalline resin may be prepared by a polycondensation process of reacting an organic diol and an organic diacid in the presence of a polycondensation catalyst. In embodiments, a stoichiometric equimolar ratio of organic diol and organic diacid may be utilized. However, in some instances, wherein the boiling point of the organic diol is from about 180° C. to about 230° C., an excess amount of diol can be utilized and removed during the polycondensation process.

The amount of catalyst utilized may vary, and can be selected in an amount, for example, of from about 0.01 to about 1 mole percent of the resin. Additionally, in place of an organic diacid, an organic diester can also be selected, with an alcohol byproduct generated during the process.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be present in an amount of from about 45 to about 50 mole percent of the resin, in embodiments from about 47 to about 49 mole percent of the resin, and the alkali sulfo-aliphatic diol can be present in an amount of from about 1 to about 10 mole percent of the resin, in embodiments from about 2 to about 8 mole percent of the resin.

Examples of organic diacids or diesters suitable for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid; diesters or anhydrides thereof; and alkali sulfo-organic diacids such as the sodium, lithium or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or combinations thereof. The organic diacid may be present in an amount of, for example, from about 40 to about 50 mole percent of the resin, in embodiments from about 42 to about 48 mole percent of the resin, and the alkali sulfo-aliphatic diacid can be present in an amount of from about 1 to about 10 mole percent of the resin, in embodiments from about 2 to about 8 mole percent of the resin.

Suitable polycondensation catalysts for production of either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or combinations thereof. Catalysts may be utilized in amounts of, for example, from about 0.01 mole percent to about 5 mole percent based on the starting diacid or diester used to generate the polyester resin, in embodiments from about 0.5 to about 4 mole percent of the resin based on the starting diacid or diester used to generate the polyester resin.

Toners of the present disclosure may also include a colorant. The colorant in the toner can be a pigment, dye, combinations thereof, and the like. Suitable colorants include, for example, carbon black like REGAL 330® magnetites, such as Mobay magnetites M08029™, M08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Ulhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTAT™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Optionally, a toner of the present disclosure may include a wax. A wax can be present in an amount of from about 4 to about 12 percent by weight of the toner particles, in embodiments from about 6 to about 10 percent by weight of the toner particles. Examples of waxes, if present, include natural waxes like carnauba, fisher-tropsch waxes, polypropylene waxes, and polyethylene waxes commercially available from Allied Chemical and Baker Petrolite Corporation, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected usually possess a molecular weight of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax. Combinations of the foregoing waxes may be utilized in embodiments.

Toners of the present disclosure may be formed by any method within the purview of those skilled in the art. Suitable methods, include, but are not limited to, melt mixing, and the like. In embodiments, toners of the present disclosure may be formed by melt mixing utilizing methods and apparatus within the purview of those skilled in the art. For example, melt mixing of the toner ingredients can be accomplished by physically mixing or blending the particles and then melt mixing, for example, in an extruder or a Banbury/two roll mill apparatus. Suitable temperatures may be applied to the extruder or similar apparatus, for example from about 65° C. to about 200° C., in embodiments from about 80° C. to about 120° C.

The components of the toner, including the amorphous resin, the crystalline resin, wax, if any, colorant, and other additives, may be combined so that the toner extrudate has the desired composition of colorants and additives. The toner extrudate may then, in embodiments, be divided into a pellet or rough crushed form, sometimes referred to herein as "pelletizing," utilizing methods within the purview of those skilled in the art, for example, by pelletizers, fitzmilling, pinmilling, grinders, classifiers, additive blenders, screeners, combinations thereof, and the like. As used herein, "pelletizing" may include any process within the purview of those skilled in the art which may be utilized to form the toner extrudate into pellets, a rough crushed form, or coarse particles, and "pellets" include toner extrudate divided into pellet form, rough crushed form, coarse particles, or any other similar form.

The addition of a crystalline polyester to an amorphous polyester in forming the binder resin may result in a suppression of the glass transition temperature (Tg) of the toner, sometimes referred to herein, in embodiments, as plasticization. Plasticization may not be desirable because if the Tg is too low for a toner, there may be problems in storage, for example blocking, and usage of the toner at elevated temperatures. Thus, in embodiments, it may be desirable to treat the toner to increase its Tg. Suitable methods for treating the toner include, but are not limited to, annealing, slow cooling, combinations thereof, and the like.

For example, in embodiments the toner may be subjected to an annealing step. In accordance with the present disclosure, this annealing step may occur by continuously processing the toner by introducing toner pellets produced after melt-mixing into a heating device, in embodiments a rotary kiln, fluidized bed dryer, combinations thereof, and the like, where the toner is heated to a temperature above its Tg. Suitable devices for annealing the toners may be readily constructed or obtained from commercial sources including, for example, rotary kilns from Harper Corporation. In embodiments, a rotary kiln from Harper Corporation which may be utilized may have a diameter of about 5 inches, a length of about 6 feet, and can operate at from about 1 revolutions per minute (rpm) to about 15 rpm, with a maximum kiln angle of about 30 degrees.

In embodiments, heating the toner to a temperature above its Tg, sometimes referred to herein, in embodiments, as annealing, may allow the polymer system of the binder resin to relax, thereby permitting the crystalline domains of the crystalline polyester component of the binder to recrystallize. This recrystallization will increase the Tg of the toner, thereby avoiding the storage and usage problems which may otherwise occur with a toner having a low Tg.

By heating the toner as described herein, the binder resin may experience an increase in crystallinity and its amorphous state may be minimized. The toners described herein prior to annealing may have a Tg below about 45° C. and, in embodiments from about 25° C. to about 45° C., in embodiments from about 39° C. to about 43° C. Thus, in embodiments, a suitable temperature for annealing may be from about 50° C. to about 90° C., in embodiments from about 60° C. to about 80° C. As the temperature is increased above Tg, the toner becomes increasingly sticky. Amorphous resin is said to be fully molten when the temperature is about 60° C. above the Tg. The goal is to find a temperature range above the Tg where the toner is soft, but firm. The higher the temperature above Tg, the faster the annealing rate. However, this must be balanced with the ability to process the toner. In embodiments, annealing the toner may occur for a period of time from about 2 minutes to about 60 minutes, in embodiments from about 15 minutes to about 45 minutes. After annealing, the toner may experience an increase in Tg due to decreased plasticization. In embodiments, after annealing, the resulting toner particles may possess a glass transition temperature of from about 43° C. to about 65° C., in embodiments from about 46° C. to about 51° C.

The binder resin, including the amorphous and crystalline resins described above, may be present in the resulting toner in an amount from about 50 weight percent to about 99 weight percent of the toner composition, in embodiments from about 70 weight percent to about 97 weight percent of the toner composition, with the colorant being present in an amount from about 1 to about 50 weight percent of the toner composition, in embodiments from about 3 to about 20 weight percent of the toner composition.

After annealing, the toner pellets may be cooled to a temperature below the toner Tg, in embodiments at a temperature of from about 20° C. to about 24° C., and then subjected to grinding utilizing, for example, an Alpine AFG fluid bed grinder, or Sturtevant micronizer, for the purpose of achieving toner particles with a volume median diameter of less than about 25 microns, in embodiments from about 5 microns to about 15 microns, in other embodiments from about 5.5 microns to about 12 microns, which diameters can be determined by a Multisizer II from Beckman Coulter. Subsequently, the toner compositions can be classified utilizing, for example, a Donaldson Model B classifier for the purpose of removing toner fines, that is, toner particles less than about 5 microns volume median diameter.

The resulting particles can possess an average volume particle diameter of about 5 microns to about 15 microns, in embodiments from about 5.5 microns to about 12 microns. The resulting toner particles may possess a glass transition temperature of from about 43° C. to about 65° C., in embodiments from about 46° C. to about 51° C. As would be apparent to one skilled in the art, the maximum value for the glass transition temperature may be dependent upon the amorphous resin. For example, if the amorphous resin has a glass transition temperature of 55° C., the maximum value the annealed toner could achieve is 55° C. Annealing thus reduces plasticization and allows the glass transition temperature of the plasticized toner to increase toward the glass transition temperature of the original amorphous resin.

A suitable system for carrying out the continuous annealing described herein may utilize the above systems and any other components within the purview of those skilled in the art. In embodiments, a suitable system for continuously forming and annealing toner may include a melt-mixing device to form an extruded toner; a pelletizer, pinmill, fitzmill, or other device to form the extruded toner into pellets, rough crushed form, coarse particles, or the like; and a continuous annealing device such as rotary kilns, fluidized bed dryers, and combinations thereof to form the desired toner particles.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLE 1

A toner of the present disclosure was produced as follows. A toner containing 20% CPES A3C crystalline polyester (a proprietary blend of 1,4-butanediol, fumaric acid, and adipic acid available from Kao Corporation (Japan)), 51% propoxylated bisphenol-A fumarate, 24% partially crosslinked propoxylated bisphenol-A fumarate, and 5% carbon black was melt-mixed in a Werner and Pfleiderer ZSK-25MC extruder. The extruder conditions were 60 pounds per hour, 380 revolutions per minute (rpm), and barrel temperatures of the 12 barrel heating zones of 80° C. (zone 1), 110° C. (zone 2), 120° C. (zone 3), 90° C. for 7 consecutive zones (zones 4 through 10), then 120° C. for the last 2 zones (zones 11 and 12).

Samples of the above toner were taken. The first sample was not annealed and is referred to as the control. Four additional samples were taken and annealed according to the conditions set forth below in table 1. The toners of the present disclosure subjected to annealing and the control toner, i.e., the toner not subjected to annealing, were then subjected to modulated differential scanning calorimetry to determine their Tg. Results obtained as well as a summary of the time of annealing and annealing temperature, are summarized below in Table 1.

TABLE 1

| Anneal Time (Minutes) | Anneal Temperature (° C.) | Tg (° C.) |
|---|---|---|
| O (Control) | N/A | 42 |
| 15 | 60 | 46.4 |
| 15 | 70 | 49.5 |
| 30 | 60 | 48 |
| 30 | 70 | 51.4 |

As can be seen from Table 1, the toners processed in the rotary kiln all exhibited an increase in Tg of the toner compared to the same toner without the annealing treatment, regardless of the time and temperature utilized in the annealing step. It was also observed that toners were less plasticized because their Tg values increased.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

melt-mixing an amorphous resin, a crystalline resin, an optional wax, and a colorant to form a toner;

pelletizing the toner;

continuously annealing the pelletized toner by heating the toner to a temperature of from about 50° C. to about 90° C. for a period of time from about 2 minutes to about 60 minutes, said temperature being above the glass transition temperature of the toner;

processing the annealed toner to form toner particles; and recovering the resulting toner particles wherein the annealing increases the glass transition temperature of the toner toward the glass transition temperature of the amorphous resin.

2. A process in accordance with claim 1, wherein the glass transition temperature of the toner prior to annealing may be from about 25° C. to about 45° C.

3. A process in accordance with claim 1, wherein continuously annealing the toner occurs by heating the toner particles to a temperature from about 60° C. to about 80° C., for a period of time from about 15 minutes to about 45 minutes.

4. A process in accordance with claim 1, wherein continuously annealing the toner occurs in an apparatus comprising a rotary kiln.

5. A process in accordance with claim 1, wherein the binder resin is present in the toner in an amount from about 50 weight percent to about 99 weight percent of the toner composition.

6. A process in accordance with claim 1, wherein the colorant comprises a pigment, dye, or combinations thereof present in an amount from about 1 to about 50 weight percent of the toner composition.

7. A process in accordance with claim 1, wherein the amorphous polymer is selected from the group consisting of polyester resins, branched polyester resins, partially crosslinked polyester resins, and combinations thereof, and the crystalline polymer comprises a polyester.

8. A process in accordance with claim 1, wherein the crystalline polymer comprises a monomer system including an alcohol selected from the group consisting of 1,4-butanediol, 1,6-hexanediol, 1,10-decanediol, and combinations thereof, with a dicarboxylic acid selected from the group consisting of fumaric acid, succinic acid, oxalic acid, adipic acid, sebacic acid, and combinations thereof.

9. A process in accordance with claim 1, wherein the crystalline polymer comprises a polyester.

10. A process in accordance with claim 1, wherein the toner particles after annealing possess a volume median diameter of from about 5 microns to about 15 microns and a glass transition temperature of from about 43° C. to about 65° C.

11. A process in accordance with claim 1, wherein contacting the binder resin with a colorant further comprises contacting the binder resin and colorant with a wax.

12. A process comprising:

contacting an amorphous polymer selected from the group consisting of polyester resins, branched polyester resins, polyimide resins, branched polyimide resins, and combinations thereof, with a crystalline polymer to form a binder resin;

contacting the binder resin with a colorant comprising a pigment, dye, optional wax, or combinations thereof;

melt-mixing the binder resin, colorant, and optional wax to form a toner;

pelletizing the toner to form toner pellets;

continuously annealing the toner pellets in an apparatus comprising a rotary kiln, by heating the toner to a temperature of from about 50° C. to about 90° C. for a period of time from about 2 minutes to about 60 minutes, said temperature being above the glass transition temperature of the toner;

processing the annealed toner to form toner particles; and recovering the resulting toner particles wherein the annealing increases the glass transition temperature of the toner toward the glass transition temperature of the amorphous resin.

13. A process in accordance with claim 12, wherein the glass transition temperature of the toner prior to annealing is from about 39° C. to about 43° C., and continuously annealing the toner occurs by heating the toner particles to a temperature from about 60° C. to about 80° C., for a period of time from about 15 minutes to about 45 minutes.

14. A process in accordance with claim 12, wherein the binder resin is present in the toner in an amount from about 70 weight percent to about 97 weight percent of the toner composition, the colorant is present in an amount from about 3 to about 20 weight percent of the toner composition, and the resulting toner particles possess a volume median diameter of from about 5 microns to about 15 microns.

15. A process in accordance with claim 12, wherein the crystalline polymer comprises a monomer system including an alcohol selected from the group consisting of 1,4-butanediol, 1,6-hexanediol, 1,10-decanediol, and combinations thereof, with a dicarboxylic acid selected from the group consisting of fumaric acid, succinic acid, oxalic acid, adipic acid, sebacic acid, and combinations thereof.

16. A process in accordance with claim 12, wherein the crystalline polymer comprises a polyester.

17. A process in accordance with claim 12, wherein the resulting toner particles possess a volume median diameter of from about 5.5 microns to about 12 microns.

18. A process in accordance with claim 12, wherein contacting the binder resin with a colorant further comprises contacting the binder resin and colorant with a wax selected from the group consisting of polypropylene waxes, polyethylene waxes, and combinations thereof.

* * * * *